US008047136B2

(12) United States Patent
MacDougall et al.

(10) Patent No.: US 8,047,136 B2
(45) Date of Patent: Nov. 1, 2011

(54) PROJECTILE FOR SIMULATING MULTIPLE BALLISTIC IMPACTS

(75) Inventors: Duncan A. S. MacDougall, Derby (GB); David Higginbottom, Rothley (GB)

(73) Assignee: Rolls-Royce plc, London (GB)

( * ) Notice: Subject to any disclaimer, the term of this patent is extended or adjusted under 35 U.S.C. 154(b) by 285 days.

(21) Appl. No.: 12/453,325

(22) Filed: May 7, 2009

(65) Prior Publication Data

US 2009/0320710 A1 Dec. 31, 2009

(30) Foreign Application Priority Data

May 29, 2008 (GB) ..... 0809646.3
Jun. 4, 2008 (GB) ..... 0810108.1

(51) Int. Cl.
*F42B 12/00* (2006.01)

(52) U.S. Cl. ..... 102/502; 102/489; 102/498; 102/293; 102/520; 102/491

(58) Field of Classification Search ..... 102/502, 102/489, 498, 529, 293, 520, 491, 494
See application file for complete search history.

(56) References Cited

U.S. PATENT DOCUMENTS

| | | | | |
|---|---|---|---|---|
| 4,119,037 | A | 10/1978 | Romer et al. | |
| 4,262,597 | A * | 4/1981 | Olson | 102/502 |
| H485 | H * | 7/1988 | Rousseau | 273/362 |
| 4,754,706 | A | 7/1988 | Fauvel et al. | |
| 6,012,395 | A * | 1/2000 | Saxby | 102/502 |
| 6,298,841 | B1 * | 10/2001 | Cheng et al. | 124/56 |
| 6,802,262 | B1 * | 10/2004 | Warnagiris et al. | 102/502 |
| 7,013,810 | B1 * | 3/2006 | Brydges-Price | 102/502 |
| 2004/0089186 | A1 * | 5/2004 | Brygdes-Price | 102/502 |

FOREIGN PATENT DOCUMENTS

| | | | |
|---|---|---|---|
| GB | 2 244 795 | A | 12/1991 |
| WO | WO 2007/053130 | A1 | 5/2007 |

* cited by examiner

*Primary Examiner* — Michael David
(74) *Attorney, Agent, or Firm* — Oliff & Berridge, PLC

(57) ABSTRACT

A projectile is provided for simulating multiple sequential ballistic impacts. The projectile has a plurality of relatively dense loading layers spaced along the firing direction of the projectile. Each pair of nearest-neighbor loading layers is separated by a less dense support element which maintains the spacing of the loading layers. The projectile may be suitable for simulating bird slurry impacts on stator vanes of an aero gas turbine engine.

8 Claims, 2 Drawing Sheets

PROJECTILE FOR SIMULATING MULTIPLE BALLISTIC IMPACTS

Figure 1:
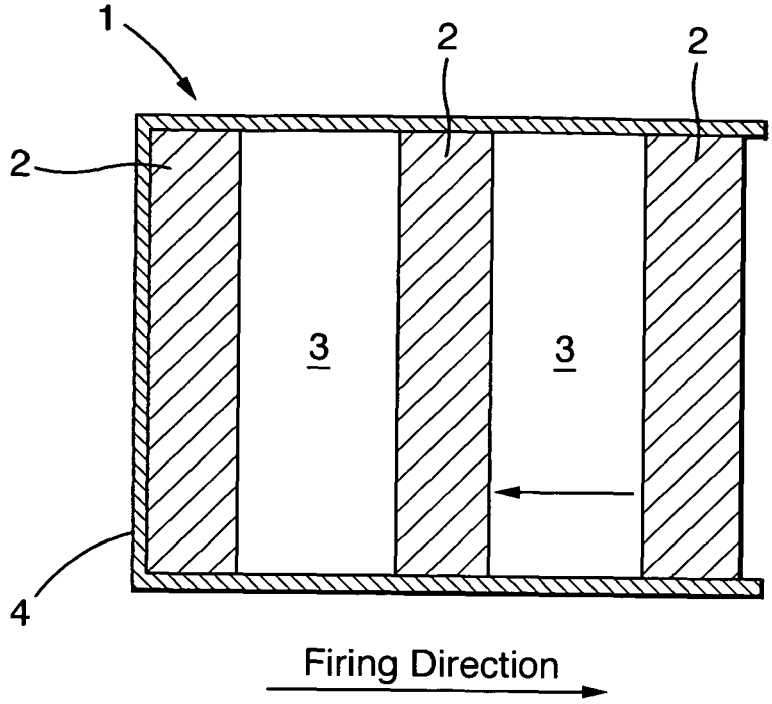

The present invention relates to projectiles for simulating multiple ballistic impacts, and particularly but not exclusively to projectiles for simulating bird slurry impacts in aero gas turbine engines.

Aircraft and aircraft engines have to undergo rigorous testing to demonstrate safe operation should a bird strike event occur.

When a bird strikes a rotor of a aero gas turbine engine, such as the low pressure rotor of a turbofan engine, the bird is sliced by the rotor blades, and the static vanes located directly behind the rotor are subjected to impact from a bird slurry. The static vanes usually experience impact from several pulses of slurry, with each pulse being associated with a slice of bird taken by a rotor blade. The frequency of these pulses of bird slurry is that of the blade passing frequency; typically about 3 kHz. Vanes can be tested to ensure they can withstand this type of slurry loading in two ways.

Firstly, it is possible to carry out a full-scale simulation of the bird strike event using a test rig having a full rotor and a set of vanes. In this way, the static vanes receive pulses of bird slurry at a frequency and energy that correspond to those experienced in practice. However, this method is costly and is only viable late in an engine development programme as a validation step.

A second method to gain understanding of the bird slurry capability of a vane is to fix a single vane or a small sector of vanes to a bench fixture, and then to fire a single cloud of simulated bird slurry (for example minced gelatine and polystyrene prepared to the correct density) out of a gas gun. Whilst some care is needed with fixture design to represent the engine restraints, this method is relatively easy to set up, and is much lower cost than a rotor rig or engine test.

The second method is a useful test during development of a static component which may be subjected to bird slurry loading. However, it only assesses the response of a target to single pulses of slurry, whereas during a bird strike event the rotor of a turbofan engine will produce bird slurry pulses at a frequency dictated by the rotor passing frequency. Thus the response of a target to successive bird slurry pulses is not investigated using the second test method. In particular, if the frequency of the bird slurry pulses coincides with a fundamental modal frequency of the vanes behind the rotor, then multiple pulses of slurry may have a much larger effect on the vanes than a single pulse would have.

In general terms, the present invention provides a projectile for simulating multiple sequential ballistic impacts but which, in the case of testing bird slurry loading, does not require a test rig having a full rotor and a set of vanes.

Thus a first aspect of the invention provides a projectile for simulating multiple sequential ballistic impacts, the projectile having:

a plurality of relatively dense loading layers spaced along the firing direction of the projectile, each pair of nearest-neighbour loading layers being separated by a less dense support element which maintains the spacing of the loading layers. For example, the projectile may have three or more loading layers. Typically, the projectile is cylindrical, the loading layers and support element(s) being disc-shaped cylinder sections.

When the projectile is fired as a target, the loading layers will impact at a frequency which depends on their spacing and the velocity of the projectile. Thus, by suitable configuration of the projectile, it is possible to simulate, for example, the pulsed impacts of bird slurry loading in a test involving just one or a limited number of stator vanes. The support element (s), being less dense than the loading layers, can be configured to exert a relatively insignificant impact load on the target.

Preferably, the projectile further has a sabot housing the loading layers and the or each support element. The sabot can facilitate the loading of the projectile into a gun, and can also help the projectile to attain higher velocities.

The loading layers may have a density of at least 100 $kgm^{-3}$, and preferably at least 300 $kgm^{-3}$. The or each support element may have a density of at most 1000 $kgm^{-3}$, and preferably of at most 250 $kgm^{-3}$.

The loading layers may have a thickness in the firing direction of at least 5 mm, and preferably of at least 10 or 20 mm. The or each support element may have a thickness in the firing direction of at least 10 mm, and preferably of at least 20 or 40 mm. The projectile may have a diameter of at least 50 mm, and preferably of at least 100 mm.

The loading layers may comprise a gel phase. Additionally, the loading layers may further comprise a solid phase. A gel or gel-solid mixture can be used to simulate the density and consistency of bird slurry.

Preferably, the or each support element comprises a plurality of discrete sub-elements which are configured to split apart in flight and to separate from the loading layers. In this way, the support element can be configured to, at least partially, avoid impact with the target. For example, the discrete sub-elements may be in abutting, non-bonded contact. In some embodiments, the sub-elements may be particulates. In other embodiments, the or each support element may have one or more cavities, with the discrete sub-elements providing respective wall portions which define said cavities.

To further encourage the support element to fall away, the or each support element may have and one or more grooves extending around the outer perimeter surface of the support element. The grooves can increase the air resistance exerted on the support element during flight. To maximise such resistance, preferably the grooves extend in a direction substantially perpendicularly to the direction of flight of the projectile.

Preferably, the support element has fore and aft wall portions which extend over substantially the entirety of the respective faces of the pair of loading layers whose spacing the support element maintains.

The or each support element may be formed of expanded polystyrene.

The projectile may be configured to be suitable for simulating bird slurry impacts on stator vanes of an aero gas turbine engine.

A further aspect of the invention provides a gun, such as a gas gun, loaded with the projectile of the first aspect.

Another aspect of the invention provides a method of simulating multiple ballistic impacts comprising firing the projectile according to the first aspect of the invention at a target. Preferably, the target is one or more stator vanes of an aero gas turbine engine.

Figure 2A:
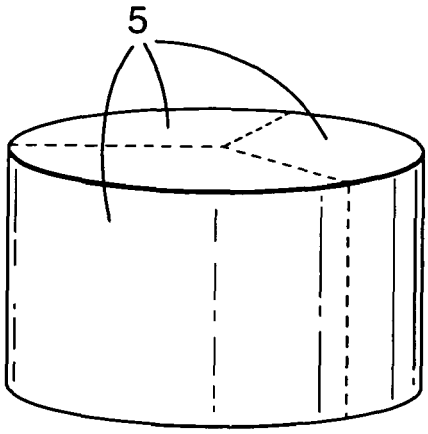
Figure 2B:
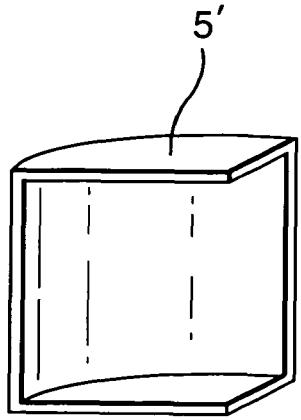
Figure 3:
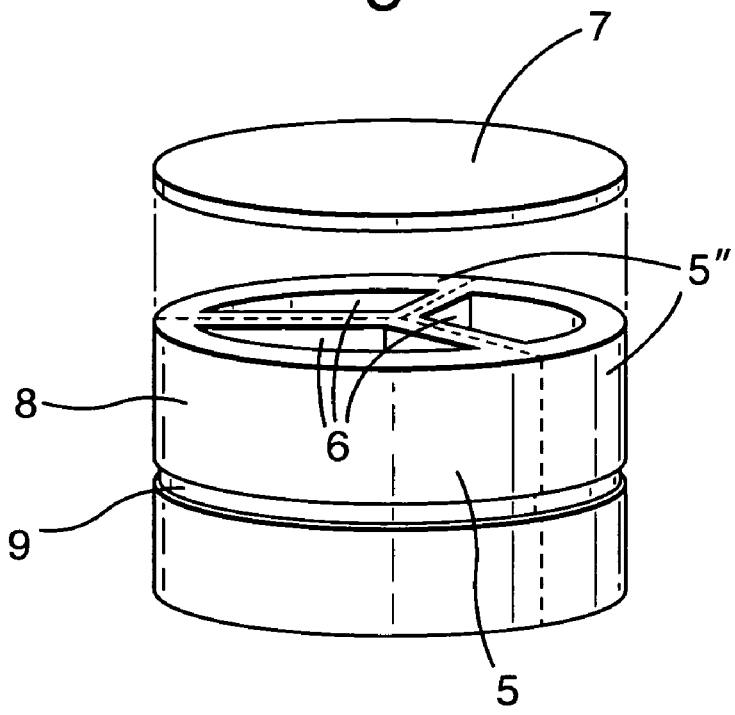
Figure 4:
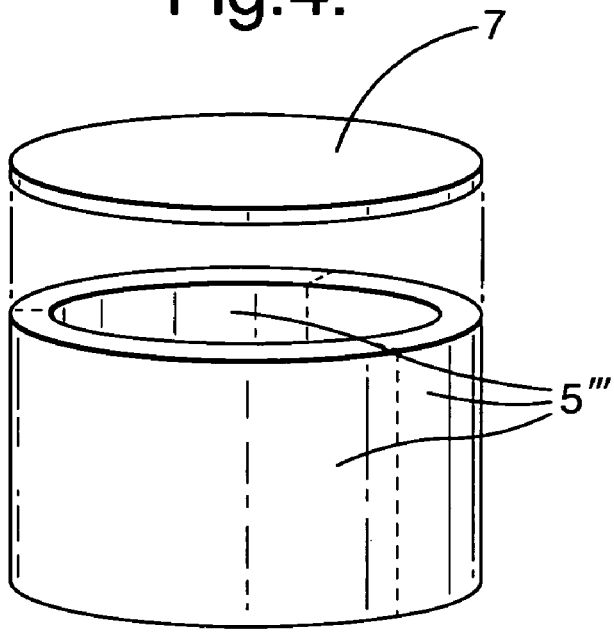

Embodiments of the invention will now be described by way of example with reference to the accompanying drawings in which:

FIG. 1 is a schematic longitudinal cross-sectional view of a projectile according to the invention;

FIG. 2*a* is a schematic perspective view of a support element for a projectile;

FIG. 2*b* is a schematic perspective view of a sub-element for another support element for a projectile;

FIG. 3 is a schematic perspective view of another support element for a projectile; and FIG. 4 is a schematic perspective view of another support element for a projectile.

FIG. 1 shows a schematic longitudinal cross-sectional view of a cylindrical projectile 1 according to the invention. The projectile has spaced loading layers 2 of simulated bird slurry that alternate, in the firing direction of the projectile, with support elements 3. Each layer 2 provides a respective pulse of simulated bird slurry when the projectile is fired at a target. The support elements 3 help the simulated bird slurry layers 2 to maintain their shape and spacing.

The projectile 1 has a surrounding sabot 4 that facilitates loading of the projectile into a gas gun. On firing, the sabot also traps propellant gases and allows the projectile to attain high velocities. The sabot is constructed so that the forward face of the endmost simulated bird slurry layer is exposed. The projectile is loaded into the barrel of the gun with this face closest to the muzzle.

The sabot 4 is made up of several pieces of low density material, such as plastic, aluminium, or wood. The pieces of the sabot are loosely connected such that, when the projectile is fired and leaves the barrel of the gun, the increased air resistance outside the barrel causes the pieces to fall away as the projectile continues its flight towards the target.

Each of the support elements 3 has a significantly lower density than that of each of the simulated bird slurry layers 2. Thus, on impact with the target, the support elements 3 cause little additional loading of the target.

Due to the presence of the support elements 3 between the simulated bird slurry layers 2, the simulated bird slurry impacts the target in discrete pulses. The pulse frequency is determined by the projectile velocity and the combined thickness of one simulated bird slurry layer and one support layer.

Typically, the projectile velocity on impact is about 200 $ms^{-1}$. Thus, with a combined thickness of a simulated bird slurry layer and a support element of about 60 mm, an impact pulse frequency of about 3 kHz can be achieved, which corresponds with the typical blade passing frequency of a low pressure rotor.

Three layers of simulated bird slurry can be packed into the sabot, the sabot typically being about 250 mm long for a 6" (15 cm) diameter gun barrel. Each simulated bird slurry layer 4 has a thickness of about 20 mm.

The simulated bird slurry typically contains a gel mixed with polymer particles. The gelling agent used in the gel may be gelatine, or any one of a number of substances including agar, carrageenan, pectin, konnyaku, locust bean gum, alginates, gellan gum, hypromellose, hydroxypropyl methyl cellulose, xanthan gum, and starch. The gel is typically minced after forming for mixing with the polymer particles.

The polymer particles may be polystyrene balls.

The support elements 3 are formed from (typically expanded) polystyrene or other low density materials such as plastic, aluminium, or wood.

In order to promote an advantageous tendency for the support elements to fall away from the simulated bird slurry layers when the projectile is fired, each support element may consist of discrete sub-elements. For example, the support element may be formed from particulate material, which is sufficiently compacted to maintain the support element's shape during acceleration in the barrel, but after exiting from the muzzle can break up under the influence of air resistance.

FIG. 2*a* shows a disc-shaped support element that is divided into three equal sized 120° sub-elements or segments 5. The boundaries between the sub-elements extend between the faces of the support element that contact adjacent simulated bird slurry layers, and hence extend in the direction of travel of the projectile when it is fired. When the projectile leaves the barrel of the gun, the sub-elements tend to move laterally outwards and fall away under the influence of air resistance.

Other embodiments of the invention may comprise support elements consisting of two or four, or other numbers of sub-elements, and the sub-elements may vary in size and shape.

The support elements may have one or more cavities. In particular, they may be hollow or may contain pores in order to reduce their overall mass. For example, sub-element 5', shown in FIG. 2*b*, may be brought together with two identical sub-elements to form a hollow, disc-shaped support element having the same external shape as the solid-form support element shown in FIG. 2*a*.

FIG. 3 shows another disc-shaped support element formed from three equal sized 120° sub-elements or segments 5". Each sub-element has wall portions which define a cavity in the form of a channel 6 extending in the axial direction of the projectile. Thin caps 7 at either end of the support element (only one is shown) cover the channels and provide fore and aft wall portions which spread the load during acceleration and prevent the adjacent bird slurry layers entering the channels.

FIG. 4 shows another disc-shaped support element. In this case three equal sized sub-elements 5'" have wall portions which form a ring around a single central channel. Again, the support element has end caps 7 (only one is shown) for supporting the adjacent bird slurry layers and spreading the load during acceleration.

In embodiments of the projectile in which the support element has an outer wall forming an outer perimeter surface, one or more grooves can be provided around that outer surface. When the projectile is fired and the sabot has fallen away, the outer surface is exposed to still air. The grooves can then increase the aerodynamic drag on the surface, encouraging the sub-elements making up the support element also to fall away.

For example, the support element of FIG. 3 has an annular groove 9 extending around its perimeter surface 8. Such grooves need not be continuous, but to increase air resistance they preferably extend substantially perpendicularly to the direction of travel of the projectile.

Test procedures using the projectile described above to simulate multiple ballistic impacts caused by bird slurry can be relatively inexpensive to perform and rapid to set-up. However, this is not necessarily at the expense of simulation accuracy. Indeed, compared to full engine or rotor test rig experiments, an advantage of testing using the projectile is that access to the vanes is improved. This allows, for example, more detailed measurements to be made using high-speed photography.

While the invention has been described in conjunction with the exemplary embodiments described above, many equivalent modifications and variations will be apparent to those skilled in the art when given this disclosure. For example, secondary damage from bomb blasts, anti-personnel mines or other multiple shrapnel impacts can be simulated by this means using spacers and variable density elements. The same method can be used to test the impact of water-borne objects on marine propellers without the need for a hydrodynamics tank. For example, one requirement for ferries is to survive impact with 2 tonne blocks of mixed concrete, aggregate and brick whose average density is the same as that of water (i.e. a floating hazard). This could be simulated by this invention using a projectile with an overall average density of between 900 and 1100 $kgm^{-3}$.

Accordingly, the exemplary embodiments of the invention set forth above are considered to be illustrative and not limiting. Various changes to the described embodiments may be made without departing from the spirit and scope of the invention.

The invention claimed is:

1. A projectile configured to simulate multiple sequential ballistic impacts, the projectile comprising:

a plurality of relatively dense loading layers spaced along a firing direction of the projectile;

a support element that is less dense than a pair of nearest-neighbour loading layers of the plurality of relatively dense loading layers, the pair of nearest-neighbour loading layers being separated by the support element which maintains the spacing of the loading layers, wherein the loading layers comprise a gel or gel-solid mixture; and a sabot housing the loading layers and the support element.

2. The projectile according to claim 1, wherein the support element comprises a plurality of discrete sub-elements which are configured to split apart in flight and to separate from the loading layers.

3. The projectile according to claim 2, wherein the discrete sub-elements are in abutting, non-bonded contact.

4. The projectile according to claim 2, wherein the support element has an outer perimeter surface defining one or more grooves extending around the outer perimeter surface of the support element.

5. The projectile according to claim 1, wherein the support element is formed of expanded polystyrene.

6. The projectile according to claim 1, wherein the projectile is configured to simulate bird slurry impacts on stator vanes of an aero gas turbine engine.

7. A method of simulating multiple ballistic impacts comprising firing the projectile according to claim 1 at a target.

8. The method according to claim 7, wherein the target is one or more stator vanes of an aero gas turbine engine.

* * * * *

UNITED STATES PATENT AND TRADEMARK OFFICE

CERTIFICATE OF CORRECTION

PATENT NO. : 8,047,136 B2
APPLICATION NO. : 12/453325
DATED : November 1, 2011
INVENTOR(S) : Duncan A. S. MacDougall et al.

It is certified that error appears in the above-identified patent and that said Letters Patent is hereby corrected as shown below:

Col. 3, line 42, change "slurry layer 4" to --slurry layer 2--.

Signed and Sealed this
Twenty-eighth Day of August, 2012

David J. Kappos

David J. Kappos
*Director of the United States Patent and Trademark Office*